US009953575B2

(12) United States Patent
Oh et al.

(10) Patent No.: US 9,953,575 B2
(45) Date of Patent: Apr. 24, 2018

(54) LIQUID CRYSTAL DISPLAY DEVICE AND METHOD OF DRIVING THE SAME

(71) Applicant: LG DISPLAY CO., LTD., Seoul (KR)

(72) Inventors: Dae-Seok Oh, Paju-si (KR); Moon-Soo Chung, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 58 days.

(21) Appl. No.: 14/956,911

(22) Filed: Dec. 2, 2015

(65) Prior Publication Data

US 2016/0189616 A1 Jun. 30, 2016

(30) Foreign Application Priority Data

Dec. 30, 2014 (KR) ..... 10-2014-0193046

(51) Int. Cl.
*G09G 3/3258* (2016.01)
*G09G 3/36* (2006.01)

(52) U.S. Cl.
CPC ..... *G09G 3/3258* (2013.01); *G09G 3/3614* (2013.01); *G09G 3/3648* (2013.01); *G09G 2310/0213* (2013.01); *G09G 2310/0243* (2013.01); *G09G 2310/08* (2013.01); *G09G 2320/0247* (2013.01); *G09G 2320/0626* (2013.01); *G09G 2330/021* (2013.01); *G09G 2340/0435* (2013.01)

(58) Field of Classification Search
CPC .. G09G 3/3258; G09G 3/3614; G09G 3/3648; G09G 2340/0435; G09G 2310/0213; G09G 2320/0247; G09G 2310/08; G09G 2320/0626; G09G 2310/0243; G09G 2330/021
See application file for complete search history.

(56) References Cited

U.S. PATENT DOCUMENTS

2014/0085288 A1 3/2014 Choi et al.
2014/0320465 A1* 10/2014 Oh ..... G09G 3/3688 345/204
2014/0320478 A1* 10/2014 Oh ..... G09G 3/00 345/212

FOREIGN PATENT DOCUMENTS

CN 1790470 A 6/2006
CN 102467893 A 5/2012
CN 104134418 A 11/2014
CN 104134419 A 11/2014

* cited by examiner

*Primary Examiner* — Kumar Patel
*Assistant Examiner* — Amy C Onyekaba
(74) *Attorney, Agent, or Firm* — Dentons US LLP

(57) ABSTRACT

Disclosed is a method of driving a display device that includes, for example, generating a gate control signal, a data control signal and an image data using an image signal; generating a data voltage using the data control signal and the image data; generating a gate voltage using the gate control signal; and sequentially applying the gate voltage of a high level to q groups of the plurality of gate lines during q frames, respectively, where q is an integer greater than 1.

18 Claims, 7 Drawing Sheets

LIQUID CRYSTAL DISPLAY DEVICE AND METHOD OF DRIVING THE SAME

This application claims the benefit under 35 U.S.C. § 119(a) of Korean Patent Application No. 10-2014-0193046, filed on Dec. 30, 2014, in the Korean Intellectual Property Office, which is incorporated herein by reference in its entirety.

BACKGROUND OF THE INVENTION

Field of the Invention

The present disclosure relates to a display device, and more particularly, to a display device with improved display quality and a method of driving the same.

Discussion of the Related Art

Recently, as the information society progresses, display devices processing and displaying a large amount of information have rapidly advanced and various flat panel displays (FPDs) have been developed. For example, the FPDs may include liquid crystal display (LCD) devices, plasma display panel (PDP) devices, organic light emitting diode (OLED) display devices and field emission display (FED) devices. Among various FPDs, an LCD device has been widely used due to its advantages such as small size, lightweight, thin profile and low power consumption.

In general, an LCD device receives a clock of a frequency of about 60 Hz from an external system and is driven according to the clock. Since the LCD device is driven with the clock having a frequency of about 60 Hz for an image such as a static image having a relatively small change in gray level between frames as well as an image such as a moving image having a relatively large change in gray level between frames, its power consumption increases.

To reduce the power consumption, a low refresh rate (LRR) driving method where the LCD device is driven with a clock having a frequency lower than about 60 Hz for an image having a relatively small change in gray level between frames has been suggested. Since a pixel maintains a pixel voltage for a longer time period, the LRR driving method may be effectively applied to a thin film transistor (TFT) using an oxide semiconductor material which has an excellent off current property.

FIG. 1A is a timing chart showing a gate voltage and a pixel voltage of an LCD device driven by a normal driving method according to the related art, and FIG. 1B is a timing chart showing a gate voltage and a pixel voltage of an LCD device driven by a low refresh rate driving method according to the related art.

Referring to FIG. 1A, when an LCD device is driven with a frequency of about 60 Hz, a gate voltage Vgn has a high level in each of first to sixtieth frames F1 to F60 constituting one second, and a data voltage is applied to a pixel of a display panel according to the gate voltage Vgn. To reduce or prevent accumulation of charges in a liquid crystal layer, the data voltages having opposite polarities are applied to the pixel by every two frames to be maintained as a pixel voltage Vpn for one frame.

In each of the first to sixtieth frames F1 to F60, as a result, the gate voltage Vgn has a high level during a normal charging period CPn such that a data voltage of a positive polarity (+) or a negative polarity (−) is alternately applied to the pixel, and the pixel voltage Vpn of a positive polarity (+) or a negative polarity (−) is maintained during a normal holding period HPn to display an image.

The normal charging period CPn corresponds to a time interval obtained by dividing about 16.7 msec of one frame by a number of pixels in a vertical pixel column, and the normal holding period HPn corresponds to a time interval obtained by subtracting the normal charging period CPn from about 16.7 msec of one frame. For example, in a full high definition (FHD) LCD device having a resolution of 1920×1080, the normal charging period CPn and the normal holding period HPn are about 15.5 μsec and about 16.68 msec, respectively.

Referring to FIG. 1B, when an LCD device is driven with a frequency of about 1 Hz, a gate voltage Vg1 has a high level in one of first to sixtieth frames F1 to F60 constituting one second, and a data voltage is applied to a pixel of a display panel according to the gate voltage Vg1. To reduce or prevent accumulation of charges in a liquid crystal layer, the data voltages having opposite polarities are applied to the pixel by every sixty frames to be maintained as a pixel voltage Vp1 for sixty frames.

In the first to sixtieth frames F1 to F60, as a result, the gate voltage Vg1 has a high level during a low refresh rate charging period CP1 such that a data voltage of a positive polarity (+) or a negative polarity (−) is alternately applied to the pixel, and the pixel voltage Vp1 of a positive polarity (+) or a negative polarity (−) is maintained during a low refresh rate holding period HP1 to display an image.

The low refresh rate charging period CP1 corresponds to a time interval obtained by dividing about 16.7 msec of one frame by a number of pixels in a vertical pixel column, and the low refresh rate holding period HP1 corresponds to a time interval obtained by subtracting the low refresh rate charging period CP1 from about 16.7 msec of one frame. For example, in a full high definition (FHD) LCD device having a resolution of 1920×1080, the low refresh rate charging period CP1 and the low refresh rate holding period HP1 are about 15.5 μsec and about 1 sec, respectively.

In the LCD device driven by the low refresh rate driving method, the pixel is charged up by the data voltage supplied once per one second corresponding to the sixty frames, and the pixel voltage Vp1 is maintained without an additional supply of the data voltage for most of one second corresponding to the sixty frames to display an image such as a static image having a relatively small change in gray level between frames. As a result, its power consumption can be reduced.

The LCD device driven by the low refresh rate driving method may have visual artifacts such as a flicker as compared with the LCD device driven by the normal driving method.

FIG. 2A is a timing chart showing a pixel voltage of an LCD device driven by a normal driving method according to the related art, and FIG. 2B is a timing chart showing a pixel voltage of an LCD device driven by a low refresh rate driving method according to the related art.

Referring to FIG. 2A, when an LCD device is driven with a frequency of about 60 Hz, a data voltage is applied to a pixel during a normal charging period CPn where a gate voltage Vgn has a high level, and the data voltage is maintained as a pixel voltage Vpn during a normal holding period HPn obtained by subtracting the normal charging period CPn from one frame. The pixel voltage Vpn is reduced by a normal voltage drop VDn due to a leakage current through the liquid crystal layer or the thin film transistor (TFT). As a result, the pixel voltage Vpn corresponding to an initial value of the data voltage is reduced by a normal voltage drop VDn due to the leakage current during the normal holding period HPn.

Referring to FIG. 2B, when an LCD device is driven with a frequency of about 1 Hz, a data voltage is applied to a pixel during a low refresh rate charging period CP1 where a gate voltage Vgn has a high level, and the data voltage is maintained as a pixel voltage Vp1 during a low refresh rate holding period HP1 obtained by subtracting the low refresh rate charging period CP1 from sixty frames. The pixel voltage Vp1 is reduced by a low refresh rate voltage drop VD1 due to a leakage current through the liquid crystal layer or the thin film transistor (TFT). As a result, the pixel voltage Vpn corresponding to an initial value of the data voltage is reduced by a low refresh rate voltage drop VD1 due to the leakage current during the low refresh rate holding period HP1.

Since the low refresh rate holding period HP1 is longer than the normal holding period HPn, an amount of leakage current during the low refresh rate holding period HP1 is greater than an amount of leakage current during the normal holding period HPn. As a result, the low refresh rate voltage drop VD1 is greater than the normal voltage drop VDn. (VD1>VDn)

The low refresh rate voltage drop VD1 may cause visual artifacts such as a flicker of an image displayed by the LCD device.

FIG. 3 is a view showing a pixel voltage and a luminance of an LCD device driven by a low refresh rate driving method according to the related art.

Referring to FIG. 3, when an LCD device is driven with a frequency of about 1 Hz, a data voltage is applied to a pixel during a low refresh rate charging period CP1, and a pixel voltage Vp1 is maintained without an application of the data voltage during a low refresh rate holding period HP1. An absolute value of the pixel voltage Vp1 at a beginning of the low refresh rate holding period HP1 right after the data voltage is applied is greater than an absolute value of the pixel voltage Vp1 at an end of the low refresh rate holding period HP1 right before the data voltage is applied due to a leakage current during the low refresh rate holding period HP1.

As a result, a luminance L1 of an image displayed by the LCD device sharply increases from a low value to a high value during a period A corresponding to the low refresh rate charging period CP1 and the beginning of the low refresh rate holding period HP1. The period A having the sharp increase in luminance L1 may have a time of about 20 msec due to a response speed of the liquid crystal layer. The sharp increase in luminance L1 during a relatively short time period can be recognized as a flicker, and the display quality of the LCD device may be reduced due to such a flicker.

SUMMARY OF THE INVENTION

Accordingly, the present invention is directed to a display device and a method of driving the same that substantially obviate one or more problems due to limitations and disadvantages of the related art.

An advantage of the present invention is to provide a display device with improved display quality and reduced power consumption.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a display device may, for example, include a timing controlling unit that generates a gate control signal, a data control signal and an image data using an image signal; a data driving that generates a data voltage using the data control signal and the image data; a gate driving unit that generates a gate voltage using the gate control signal; and a display panel including a plurality of gate lines and a plurality of data lines crossing each other to define a plurality of pixels and driven with high and low frequencies, the low frequency (f) being less than 60 Hz for displaying an image using the data voltage, wherein the plurality of gate lines are divided into q groups, where q is an integer greater than 1, and wherein the gate voltage of a high level is sequentially applied to the q groups of the plurality of gate lines during 1/f seconds.

In another aspect of the present disclosure, a method of driving a display device having a display panel, wherein the display panel includes a plurality of gate lines and a plurality of data lines crossing each other to define a plurality of pixels and is driven with high and low frequencies, the low frequency (f) being less than 60 Hz for displaying an image using the data voltage, the method may, for example, include generating a gate control signal, a data control signal and an image data using an image signal; generating the data voltage using the data control signal and the image data; generating a gate voltage using the gate control signal; and sequentially applying the gate voltage of a high level to q groups of the plurality of gate lines during q frames, respectively, where q is an integer greater than 1.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE ILLUSTRATED EMBODIMENTS

Figure 1A:
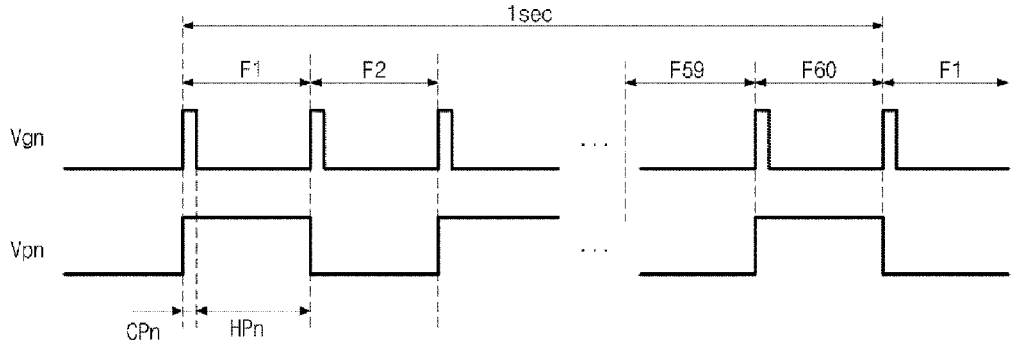
FIG. 1A Related Art
FIG. 1A is a timing chart showing a gate voltage and a pixel voltage of a liquid crystal display device driven by a normal driving method according to the related art.
Figure 1B:
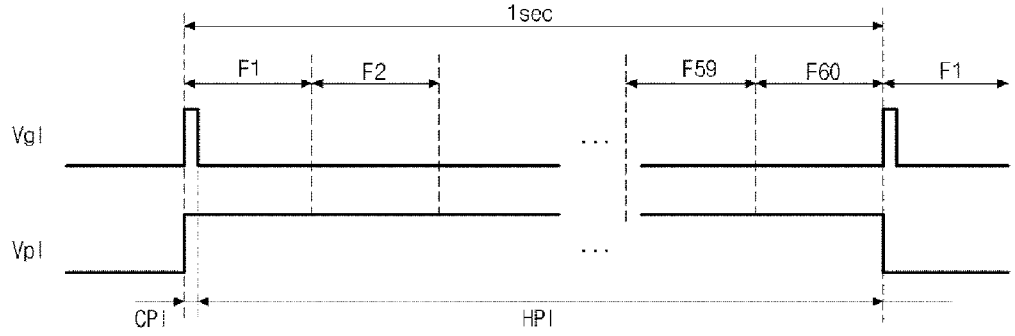
FIG. 1B Related Art
FIG. 1B is a timing chart showing a gate voltage and a pixel voltage of a liquid crystal display device driven by a low refresh rate driving method according to the related art.
Figure 2A:
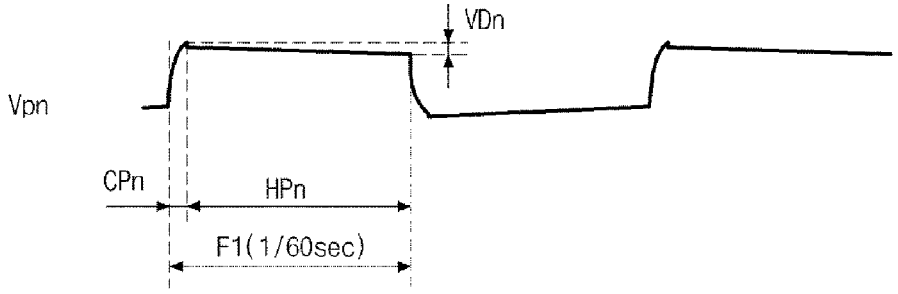
FIG. 2A Related Art
FIG. 2A is a timing chart showing a pixel voltage of a liquid crystal display device driven by a normal driving method according to the related art.
Figure 2B:
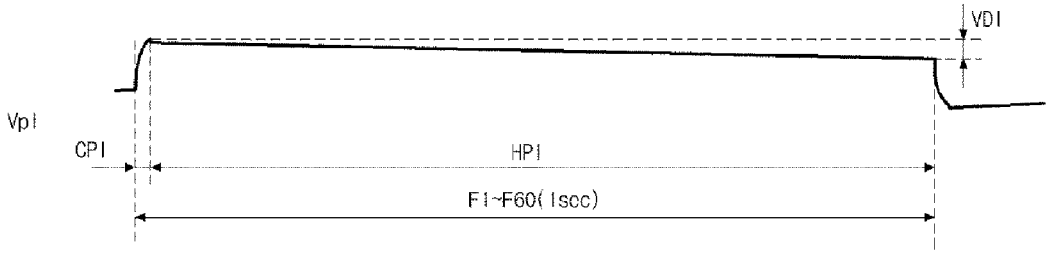
FIG. 2B Related Art
FIG. 2B is a timing chart showing a pixel voltage of a liquid crystal display device driven by a low refresh rate driving method according to the related art.
Figure 3:
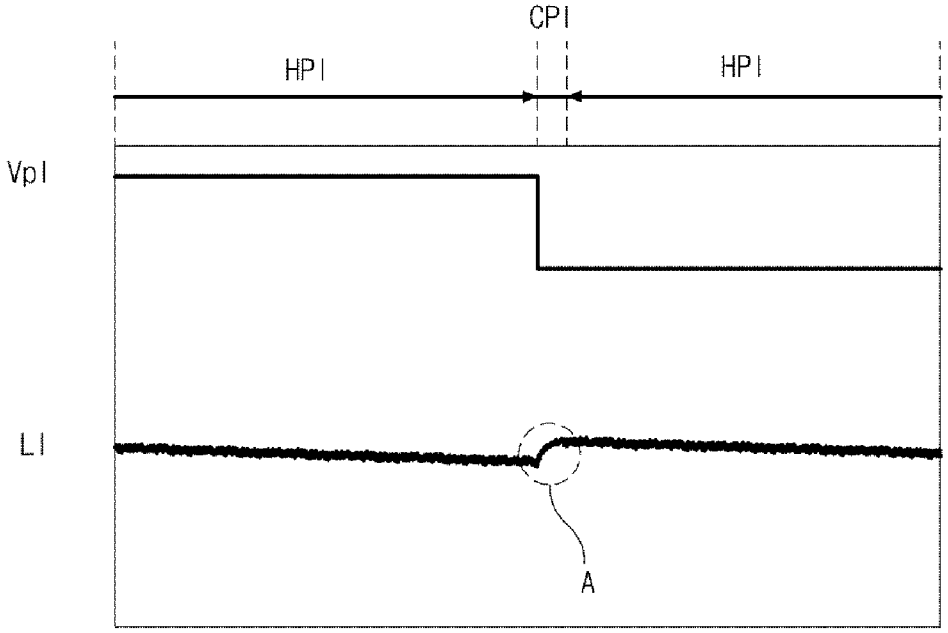
FIG. 3 Related Art
FIG. 3 is a view showing a pixel voltage and a luminance of a liquid crystal display device driven by a low refresh rate driving method according to the related art.

Reference will now be made in detail to embodiments of the present invention, examples of which are illustrated in the accompanying drawings. In the following description, when a detailed description of well-known functions or configurations related to this document is determined to unnecessarily cloud a gist of an embodiment of the disclosure, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a certain order. Like reference numerals designate like elements throughout. Names of the respective elements used in the following explanations are selected only for convenience of writing the specification and may be thus different from those used in actual products.

Figure 4:
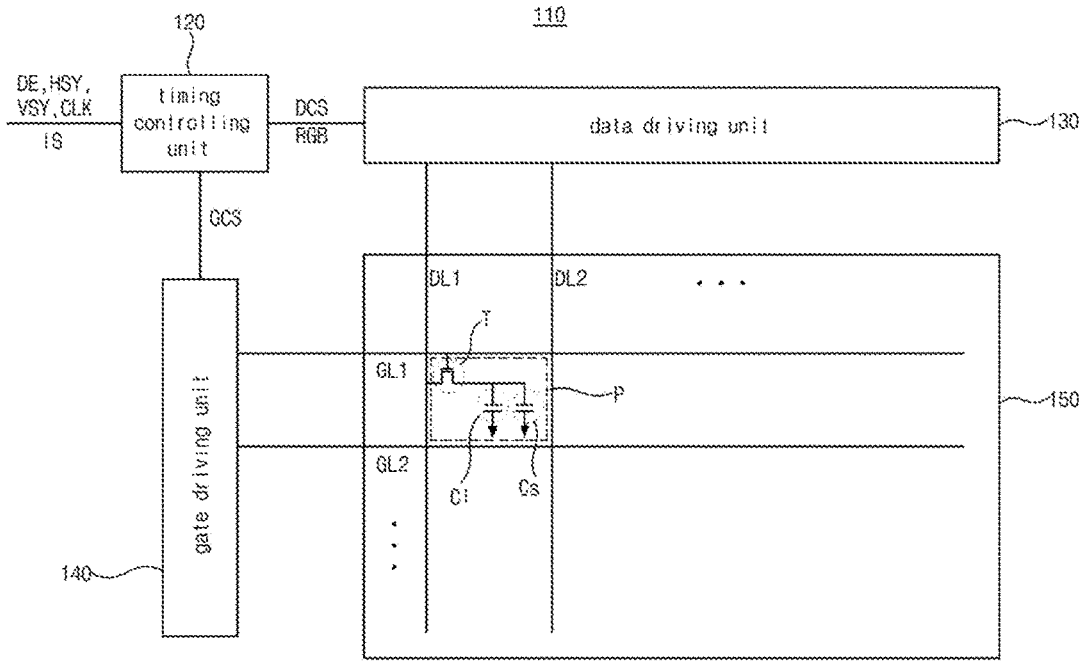
FIG. 4 is a view illustrating a liquid crystal display device according to the first embodiment of the present disclosure.

FIG. 4 is a circuit diagram illustrating a liquid crystal display (LCD) device according to the first embodiment of the present disclosure.

Referring to FIG. 4, an LCD device 110 includes a timing controlling unit 120, a data driving unit 130, a gate driving unit 140 and a display panel 150.

The timing controlling unit 120 generates a gate control signal GCS, a data control signal DCS and an image data RGB using an image signal IS and a plurality of timing signals such as a data enable signal DE, a horizontal synchronization signal HSY, a vertical synchronization signal VSY and a clock CLK transmitted from an external system such as a graphic card or a television system. The timing controlling unit 120 supplies the data control signal DCS and the image data RGB to the data driving unit 130 and supplies the gate control signal GCS to the gate driving unit 140.

For example, the gate control signal GCS may include a gate output enable GOE, a gate start pulse (GSP) and a gate shift clock (GSC), and the data control signal may include a source output enable (SOE), a source start pulse (SSP) and a source sampling clock (SSC).

The data driving unit 130 generates a data voltage using the data control signal DCS and the image data RGB supplied by the timing controlling unit 120 and supplies the data voltage to a plurality of data lines DL1 and DL2 of the display panel 150.

The gate driving unit 140 generates a gate voltage using the gate control signal GCS supplied by the timing controlling unit 120 and supplies the gate voltage to a plurality of gate lines GL1 and GL2 of the display panel 150.

The display panel 150 displays an image using the data voltage supplied by the data driving unit 130 and the gate voltage supplied by the gate driving unit 140. The display panel 150 includes the plurality of gate lines GL1 and GL2 and the plurality of data lines DL1 and DL2 crossing each other to define a plurality of pixels P, and a thin film transistor (TFT) T is connected to the plurality of gate lines GL1 and GL2 and the plurality of data lines DL1 and DL2. A liquid crystal capacitor C1 and a storage capacitor Cs are connected to the TFT T. When a high level of the gate voltage of the plurality of gate lines GL1 and GL2 is applied to the TFT T, the TFT T is turned on and the data voltage of the plurality of data lines DL1 and DL2 is transmitted to the liquid crystal capacitor C1 and the storage capacitor Cs through and the TFT T to display a gray level.

Although not shown, the liquid crystal capacitor C1 includes a pixel electrode, a common electrode and a liquid crystal layer between the pixel electrode and the common electrode, and the storage capacitor Cs maintains a voltage of the pixel electrode during one frame interval.

Figure 5:
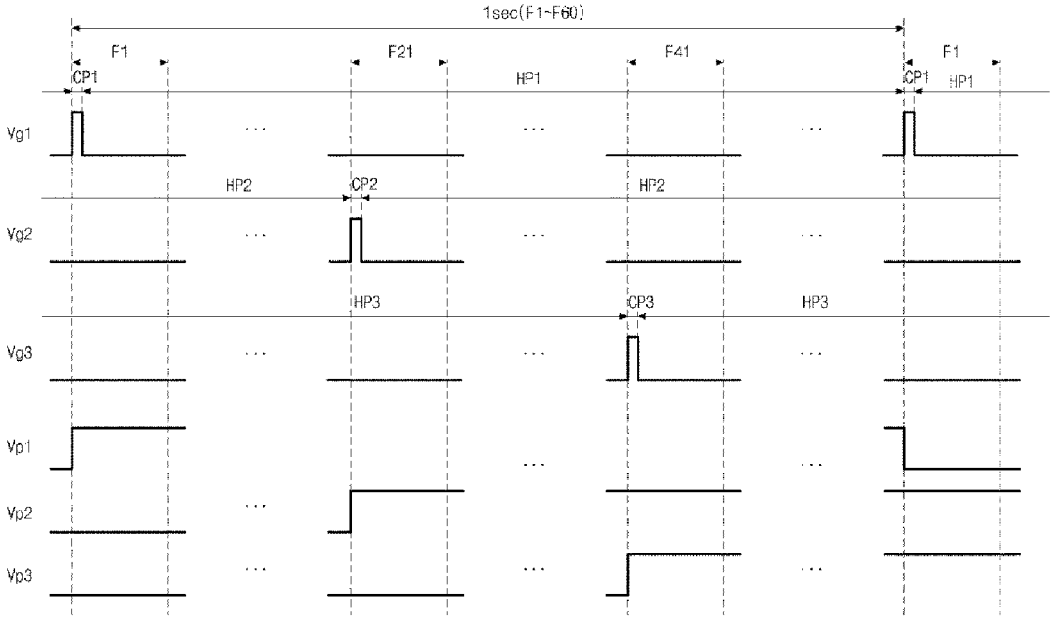
FIG. 5 is a timing chart showing a gate voltage and a pixel voltage of a liquid crystal display device driven by a low refresh rate driving method according to the first embodiment of the present disclosure.

FIG. 5 is a timing chart showing a gate voltage and a pixel voltage of an LCD device driven by a low refresh rate driving method according to the first embodiment of the present disclosure.

Referring to FIG. 5, when an LCD device 110 according to the first embodiment is driven with a frequency of about 1 Hz, one second is divided into first to sixtieth frames F1 to F60 each having about 16.7 msec, and a plurality of gate lines GL1 and GL2 are classified into first, second and third groups. For example, the first group may include (3p+1)th gate lines (p is an integer equal to or greater than 0) such as the first gate line, the fourth gate line, the seventh gate line, the tenth gate line, etc., the second group may include (3p+2)th gate lines such as the second gate line, the fifth gate line, the eighth gate line, the eleventh gate line, etc., and the third group may include (3p+3)th gate lines such as the third gate line, the sixth gate line, the ninth gate line and the twelfth gate line, etc. A gate voltage applied to the gate lines of the first, second and third groups has a high level during one of the first to sixtieth frames F1 to F60.

For example, the gate voltages Vg1, etc. of the high level may be sequentially applied to the (3p+1)th gate lines of the first group during the first frame F1, the gate voltages Vg2, etc. of the high level may be sequentially applied to the (3p+2)th gate lines of the second group during the twenty-first frame F21, and the gate voltages Vg3, etc. of the high level may be sequentially applied to the (3p+3)th gate lines of the third group during the forty-first frame F41.

The first, twenty-first and forty-first frames F1, F21 and F41 may be selected from the first to sixtieth frames F1 to F60. During the first frame F1, the first gate voltage Vg1, the fourth gate voltage Vg4, the seventh gate voltage Vg7, the tenth gate voltage Vg10, etc. of the high level may be sequentially applied to the first gate line GL1, the fourth gate line GL4, the seventh gate line GL7, the tenth gate line GL10, etc. of the first group. During the twenty-first frame F21, the second gate voltage Vg2, the fifth gate voltage Vg5, the eighth gate voltage Vg8, the eleventh gate voltage Vg11, etc. of the high level may be sequentially applied to the second gate line GL2, the fifth gate line GL5, the eighth gate line GL8, the eleventh gate line GL11, etc. of the second group. During the forty-first frame F41, the third gate voltage Vg3, the sixth gate voltage Vg6, the ninth gate voltage Vg9, the twelfth gate voltage Vg12, etc. of the high level may be sequentially applied to the third gate line GL3, the sixth gate line GL6, the ninth gate line GL9, the twelfth gate line GL12, etc. of the third group.

Accordingly, the data voltages may be sequentially applied to the pixels P corresponding to the gate lines GL1, GL4, GL7, GL10, etc. of the first group during charging periods CP1, CP4, CP7, CP10, etc. of the first frame F1. The data voltages may be sequentially applied to the pixels P corresponding to the gate lines GL2, GL5, GL8, GL11, etc. of the second group during charging periods CP2, CP5, CP8, CP11, etc. of the twenty-first frame F21. The data voltages may be sequentially applied to the pixels P corresponding to the gate lines GL3, GL6, GL9, GL12, etc. of the third group during charging periods CP3, CP6, CP9, CP12, etc. of the forty-first frame F41.

To reduce or prevent accumulation of charges in the liquid crystal layer, the data voltages having opposite polarities may be applied to the pixel by every sixty frames to be maintained as a pixel voltage Vp for sixty frames. During the charging periods CP1, CP4, CP7, CP10, etc. of the first frame F1, the gate voltages Vg1, Vg4, Vg7, Vg10, etc. corresponding to the first group may sequentially have the high level, and the data voltages having a positive polarity (+) or a negative polarity (−) may be alternately applied to a horizontal pixel row. As a result, the pixel voltages Vp1, Vp4, Vp7, Vp10, etc. having the positive polarity (+) or the negative polarity (−) may be maintained during the holding periods HP1, HP4, HP7, HP10, etc. of the first to sixtieth frames F1 to F60.

During the charging periods CP2, CP5, CP8, CP11, etc. of the twenty-first frame F21, the gate voltages Vg2, Vg5, Vg8, Vg11, etc. corresponding to the second group may sequentially have the high level, and the data voltages having a positive polarity (+) or a negative polarity (−) may be alternately applied to the horizontal pixel row. As a result, the pixel voltages Vp2, Vp5, Vp8, Vp11, etc. having the positive polarity (+) or the negative polarity (−) may be maintained during the holding periods HP2, HP5, HP8, HP11, etc. of the first to sixtieth frames F1 to F60.

During the charging periods CP3, CP6, CP9, CP12, etc. of the forty-first frame F41, the gate voltages Vg3, Vg6, Vg9, Vg12, etc. corresponding to the third group may sequentially have the high level, and the data voltages having a positive polarity (+) or a negative polarity (−) may be alternately applied to the horizontal pixel row. As a result, the pixel voltages Vp3, Vp6, Vp9, Vp12, etc. having the positive polarity (+) or the negative polarity (−) may be maintained during the holding periods HP3, HP6, HP9, HP12, etc. of the first to sixtieth frames F1 to F60.

In the LCD device 110 according to the first embodiment of the present disclosure, the power consumption is reduced due to the low refresh rate driving method. In addition, the plurality of gate lines are classified into the first, second and third groups, and the data voltages are applied to the horizontal pixel row corresponding to the first, second and third groups during the first, twenty-first and forty-first frames, respectively, which are spaced apart from each other with an equal time interval. As a result, an increase in luminance of the LCD device 110 right after the data voltage is applied may be reduced to about ⅓ of that of the LCD device according to the related art where the data voltage is applied to all of horizontal pixel rows during one frame. Accordingly, visual artifacts such as a flicker may be reduced or prevented, thereby improving the display quality of the LCD device 110.

In the LCD device 110 according to the first embodiment, the luminance increases during the first, twenty-first and forty-first frames F1, F21 and F41, and each of the first, twenty-first and forty-first frames F1, F21 and F41 has about 20 msec. Although visual artifacts such as a flicker may be reduced due to reduction of increase in luminance as compared with the LCD device according to the related art, a flicker may be recognized because the increase in luminance has a relatively short period. In another embodiment, such a flicker may be further reduced or prevented by extending the period during which the luminance increases.

Figure 6:
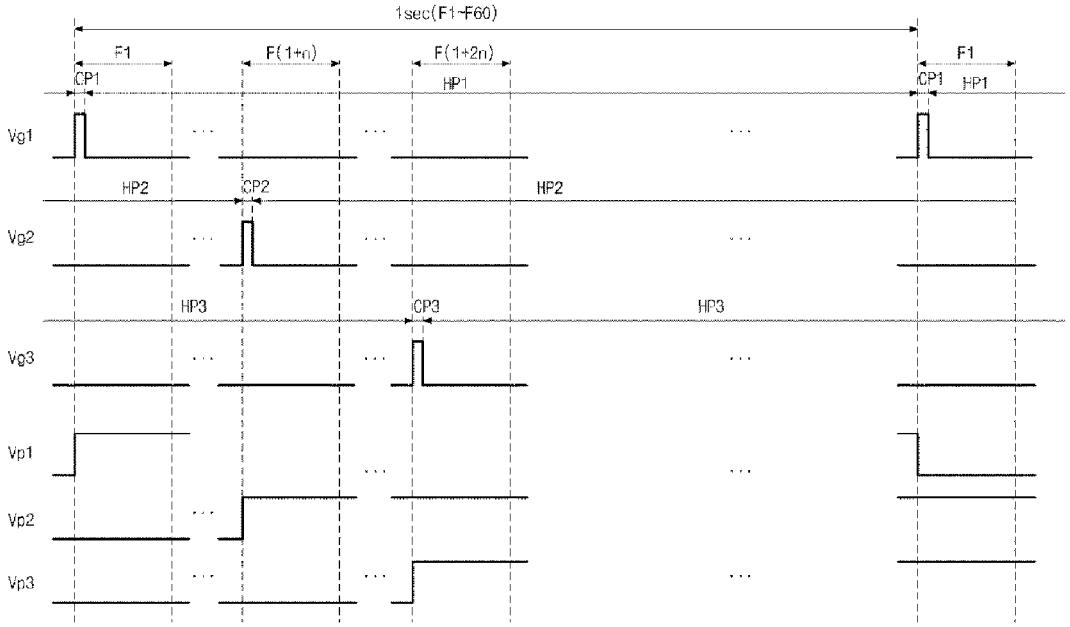
FIG. 6 is a timing chart showing a gate voltage and a pixel voltage of a liquid crystal display device driven by a low refresh rate driving method according to the second embodiment of the present disclosure.

FIG. 6 is a timing chart showing a gate voltage and a pixel voltage of an LCD device driven by a low refresh rate driving method according to the second embodiment of the present disclosure. An LCD device according to the second embodiment has the same structure as the LCD device according to the first embodiment.

Referring to FIG. 6, when an LCD device according to the second embodiment is driven with a frequency of about 1 Hz, one second is divided into first to sixtieth frames F1 to F60 each having about 16.7 msec, and a plurality of gate lines GL1 and GL2 are classified into first, second and third groups. For example, the first group may include (3p+1)th gate lines (p is an integer equal to or greater than 0) such as the first gate line, the fourth gate line, the seventh gate line, the tenth gate line, etc., the second group may include (3p+2)th gate lines such as the second gate line, the fifth gate line, the eighth gate line, the eleventh gate line, etc., and the third group may include (3p+3)th gate lines such as the third gate line, the sixth gate line, the ninth gate line and the twelfth gate line, etc. A gate voltage applied to the gate lines of the first, second and third groups has a high level during one of the first to sixtieth frames F1 to F60.

For example, the gate voltages Vg1, etc. of the high level may be sequentially applied to the (3p+1)th gate lines of the first group during the first frame F1, the gate voltages Vg2, etc. of the high level may be sequentially applied to the (3p+2)th gate lines of the second group during the (1+n)th frame F(1+n) (n is an integer equal to or greater than 1 and equal to or smaller than 5), and the gate voltages Vg3, etc. of the high level may be sequentially applied to the (3p+3)th gate lines of the third group during the (1+2n)th frame F(1+2n).

The gate voltages of the high level may be sequentially applied to the gate lines of the first, second and third groups during the first, second and third frames F1, F2 and F3, respectively, or the gate voltages of the high level may be sequentially applied to the gate lines of the first, third and fifth frames F1, F3 and F5, respectively. In addition, the gate voltages of the high level may be sequentially applied to the gate lines of the first, second and third groups during the first, fourth and seventh frames F1, F4 and F7, respectively, or the gate voltages of the high level may be sequentially applied to the gate lines of the first, fifth and ninth frames F1, F5 and F9, respectively. Alternatively, the gate voltages of the high level may be sequentially applied to the gate lines of the first, second and third groups during the first, sixth and eleventh frames F1, F6 and F11, respectively. Accordingly, the gate voltages of the high level may be applied to the gate lines of the first, second and third groups for about 33.3 msec to about 166 msec corresponding to two to ten frames.

The first, (1+n)th and (1+2n)th frames F1, F(1+n) and F(1+2n) within ten frames may be selected from the first to sixtieth frames F1 to F60. During the first frame F1, the first gate voltage Vg1, the fourth gate voltage Vg4, the seventh gate voltage Vg7, the tenth gate voltage Vg10, etc. of the high level may be sequentially applied to the first gate line GL1, the fourth gate line GL4, the seventh gate line GL7, the tenth gate line GL10, etc. of the first group. During the (1+n)th frame F(1+n), the second gate voltage Vg2, the fifth gate voltage Vg5, the eighth gate voltage Vg8, the eleventh gate voltage Vg11, etc. of the high level may be sequentially applied to the second gate line GL2, the fifth gate line GL5, the eighth gate line GL8, the eleventh gate line GL11, etc. of the second group. During the (1+2n)th frame F(1+2n), the third gate voltage Vg3, the sixth gate voltage Vg6, the ninth gate voltage Vg9, the twelfth gate voltage Vg12, etc. of the high level may be sequentially applied to the third gate line GL3, the sixth gate line GL6, the ninth gate line GL9, the twelfth gate line GL12, etc. of the third group.

Accordingly, the data voltages may be sequentially applied to the pixels P corresponding to the gate lines GL1, GL4, GL7, GL10, etc. of the first group during charging periods CP1, CP4, CP7, CP10, etc. of the first frame F1. The data voltages may be sequentially applied to the pixels P corresponding to the gate lines GL2, GL5, GL8, GL11, etc. of the second group during charging periods CP2, CP5, CP8, CP11, etc. of the (1+n)th frame F(1+n). The data voltages may be sequentially applied to the pixels P corresponding to the gate lines GL3, GL6, GL9, GL12, etc. of the third group during charging periods CP3, CP6, CP9, CP12, etc. of the (1+2n)th frame F(1+2n).

To reduce or prevent accumulation of charges in the liquid crystal layer, the data voltages having opposite polarities may be applied to the pixel by every sixty frames to be maintained as a pixel voltage Vp for sixty frames. During the charging periods CP1, CP4, CP7, CP10, etc. of the first frame F1, the gate voltages Vg1, Vg4, Vg7, Vg10, etc. corresponding to the first group may sequentially have the high level, and the data voltages having a positive polarity (+) or a negative polarity (−) may be alternately applied to a horizontal pixel row. As a result, the pixel voltages Vp1, Vp4, Vp7, Vp10, etc. having the positive polarity (+) or the negative polarity (−) may be maintained during the holding periods HP1, HP4, HP7, HP10, etc. of the first to sixtieth frames F1 to F60.

During the charging periods CP2, CP5, CP8, CP11, etc. of the (1+n)th frame F(1+n), the gate voltages Vg2, Vg5, Vg8, Vg11, etc. corresponding to the second group may sequentially have the high level, and the data voltages having a positive polarity (+) or a negative polarity (−) may be alternately applied to the horizontal pixel row. As a result, the pixel voltages Vp2, Vp5, Vp8, Vp11, etc. having the positive polarity (+) or the negative polarity (−) may be maintained during the holding periods HP2, HP5, HP8, HP11, etc. of the first to sixtieth frames F1 to F60.

During the charging periods CP3, CP6, CP9, CP12, etc. of the (1+2n)th frame F(1+2n), the gate voltages Vg3, Vg6, Vg9, Vg12, etc. corresponding to the third group may sequentially have the high level, and the data voltages having a positive polarity (+) or a negative polarity (−) may be alternately applied to the horizontal pixel row. As a result, the pixel voltages Vp3, Vp6, Vp9, Vp12, etc. having the positive polarity (+) or the negative polarity (−) may be maintained during the holding periods HP3, HP6, HP9, HP12, etc. of the first to sixtieth frames F1 to F60.

In the LCD device according to the second embodiment of the present disclosure, the power consumption is reduced due to the low refresh rate driving method. In addition, the plurality of gate lines are classified into the first, second and third groups, and the data voltages are applied to the horizontal pixel row corresponding to the first, second and third groups during the first, (1+n)th and (1+2n)th frames, respectively, which are adjacent to each other within ten frames. As a result, an increase in luminance of the LCD device right after the data voltage is applied may be reduced to about ⅓ of that of the LCD device according to the related art where the data voltage is applied to all of horizontal pixel rows during one frame. Accordingly, visual artifacts such as a flicker may be reduced or prevented, thereby improving the display quality of the LCD device.

Further, when the first, (1+n)th and (1+2n)th frames where the gate voltage of the high level is applied are adjacent to each other within five frames of about 83.3 msec, the period during which the luminance increases is extended. As a result, a flicker may not be recognized and the display quality of the LCD device may be further improved.

Figure 7:
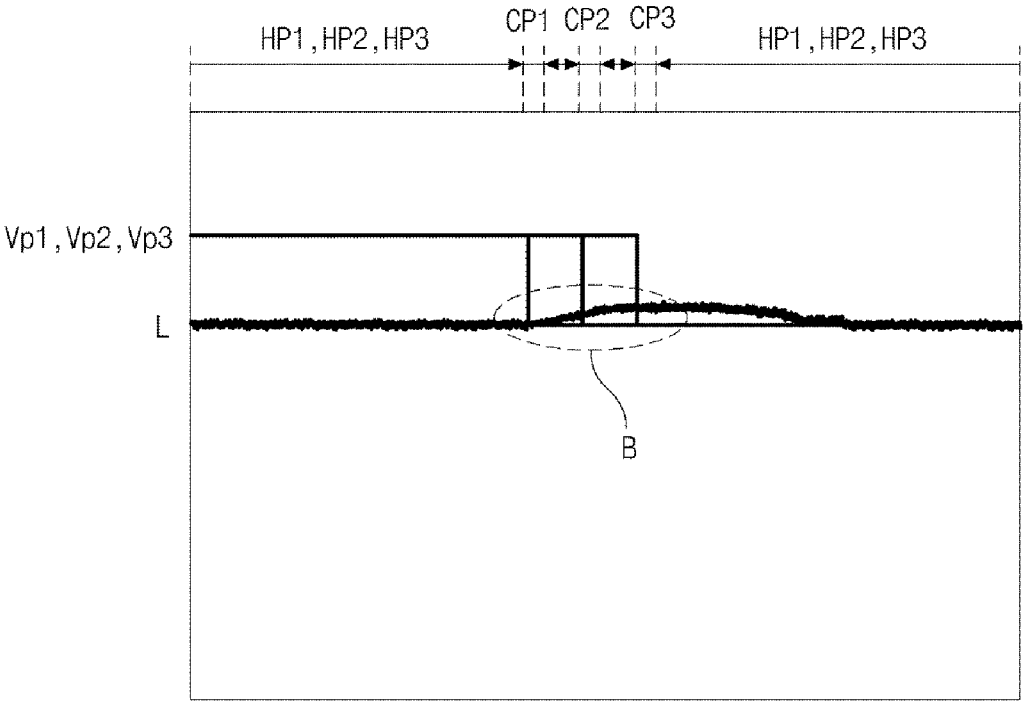
FIG. 7 is a view showing a pixel voltage and a luminance of a liquid crystal display device driven by a low refresh rate driving method according to the second embodiment of the present disclosure.

FIG. 7 is a view showing a pixel voltage and a luminance of an LCD device driven by a low refresh rate driving method according to the second embodiment of the present disclosure.

Referring to FIG. 7, when an LCD device according to the second embodiment is driven with a frequency of about 1 Hz, a data voltage is applied to a pixel during charging periods CP1, CP2, CP3, etc. of first, (1+n)th and (1+2n)th frames F1, F(1+n) and F(1+2n) (n is an integer equal to or greater than 1 and equal to or smaller than 5), and pixel voltages Vp1, Vp2, Vp3, etc. are maintained without an application of the data voltage during holding periods HP1, HP2, HP3, etc.

After a luminance of an image is reduced according to a reduction of the pixel voltages Vp1, Vp2, Vp3, etc. due to a leakage current during the holding periods HP1, HP2, HP3, etc., the luminance of the image increases according to an application of the data voltage during the charging periods CP1, CP2, CP3, etc. of first, (1+n)th and (1+2n)th frames F1, F(1+n) and F(1+2n). For example, the luminance of the image may increase by about ⅓ of an increment amount with respect to a final luminance right after the charging periods CP1, CP2, CP3, etc. due to the application of the data voltage during the first frame F1. Similarly, the luminance of the image may increase by about ⅓ of an increment amount with respect to the final luminance right after the charging periods CP1, CP2, CP3, etc. due to the application of the data voltage during the (1+n)th frame F(1+n), and the luminance of the image may increase by about ⅓ of an increment amount with respect to the final luminance right after the charging periods CP1, CP2, CP3, etc. due to the application of the data voltage during the (1+2n)th frame F(1+2n).

As a result, a section B where the luminance increases may have a time of about 37 msec to about 170 msec depending on a response speed of the liquid crystal layer. Since a gentle increase in luminance L having a relatively long time period may not be recognized as a flicker, the display quality of the LCD device can be improved.

Although the plurality of gate lines are classified into three groups in the LCD device according to the first and second embodiments of the present disclosure, the plurality of gate lines may be classified into various number of groups such as two groups or four groups. When the plurality of gate lines are classified into two groups or four groups, the gate voltage of the high level may be applied to the plurality of gate lines of the two groups or the four groups during two frames or four frames which are spaced apart from each other with, for example, an equal time interval. Alternatively, the gate voltage of the high level may be applied to the plurality of gate lines of the two groups or the four groups during two frames or four frames which are adjacent to each other within, for example, ten frames. As result, the power consumption can be reduced and/or the display quality can be improved.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

It will be apparent to those skilled in the art that various modifications and variation can be made in the present invention without departing from the concepts and scope of the invention. Thus, it is intended that the present invention cover the modifications and variations of this invention provided they come within the scope of the appended claims and their equivalents.

What is claimed is:

1. A display device comprising: a timing controller that generates a gate control signal, a data control signal and an image data using an image signal; a data driver that is connected to the timing controller and generates a data voltage using the data control signal and the image data; a gate driver that is connected to the timing controller and generates a gate voltage using the gate control signal; and a display panel including a plurality of gate lines and a plurality of data lines crossing each other to define a plurality of pixels and driven with a low frequency (f), the plurality of gate lines being connected to the gate driver and the plurality of data lines being connected to the data driver, and the low frequency (f) being less than 60 Hz for displaying an image using the data voltage, wherein the plurality of gate lines are divided into q groups, where q is an integer greater than 1, wherein the gate voltage of a high level is sequentially applied to the q groups of the plurality of gate lines during 1/f seconds, and wherein the gate voltage of the high level is applied to the q groups during q frames of sixty frames, respectively, and a plurality of other frames of the sixty frames where the gate voltage of a low level is applied are disposed between the q frames.

2. The device of claim 1, wherein the display device is a liquid crystal display (LCD) device or an organic light emitting diode (OLED) display.

3. The device of claim 1, wherein the gate voltage of the high level is sequentially applied to the q groups on a basis of 1/fq time interval.

4. The device of claim 3, wherein the gate voltage of the high level is applied to each of the q groups for a frame corresponding to the high frequency during the 1/fq time interval.

5. The device of claim 4, wherein the q frames are spaced apart from each other with an equal time interval in first to sixtieth frames.

6. The device of claim 5, wherein the q groups includes first, second and third groups and the q frames includes first, twenty-first and forty-first frames, wherein the first, second and third groups include (3p+1)th, (3p+2)th and (3p+3)th gate lines, respectively, where p is an integer equal to or greater than 0, wherein the gate voltage of the high level is sequentially applied to the (3p+1)th gate lines during the first frame, wherein the gate voltage of the high level is sequentially applied to the (3p+2)th gate lines during the twenty-first frame, and wherein the gate voltage of the high level is sequentially applied to the (3p+3)th gate lines during the forty-first frame.

7. The device of claim 6, wherein the data voltage having one of positive and negative polarities is applied to the pixel corresponding to the (3p+1)th gate lines during a first charging period of the first frame where the gate voltage of the high level is applied to the (3p+1)th gate lines, and a pixel voltage having one of the positive and negative polarities is maintained in the pixel corresponding to the (3p+1)th gate lines during a first holding period of the first to sixtieth frames, wherein the data voltage having one of positive and negative polarities is applied to the pixel corresponding to the (3p+2)th gate lines during a second charging period of the twenty-first frame where the gate voltage of the high level is applied to the (3p+2)th gate lines, and the pixel voltage having one of the positive and negative polarities is maintained in the pixel corresponding to the (3p+2)th gate lines during a second holding period of the first to sixtieth frames, and wherein the data voltage having one of positive and negative polarities is applied to the pixel corresponding to the (3p+3)th gate lines during a third charging period of the forty-first frame where the gate voltage of the high level is applied to the (3p+3)th gate lines, and the pixel voltage having one of the positive and negative polarities is maintained in the pixel corresponding to the (3p+3)th gate lines during a third holding period of the first to sixtieth frames.

8. A display device comprising: a timing controller that generates a gate control signal, a data control signal and an image data using an image signal; a data driver that is connected to the timing controller and generates a data voltage using the data control signal and the image data; a gate driver that is connected to the timing controller and generates a gate voltage using the gate control signal; and a display panel including a plurality of gate lines and a plurality of data lines crossing each other to define a plurality of pixels and driven with a low frequency (f), the plurality of gate lines being connected to the gate driver and the plurality of data lines being connected to the data driver, and the low frequency (f) being less than 60 Hz for displaying an image using the data voltage, wherein the plurality of gate lines are divided into q groups, where q is an integer greater than 1, wherein the gate voltage of a high level is sequentially applied to the q groups of the plurality of gate lines during 1/f seconds, wherein the gate voltage of the high level is applied to the q groups for q frames of sixty frames, respectively, and wherein the q frames are adjacent to each other within ten frames in first to sixtieth frames.

9. The device of claim 8, wherein the q groups includes first, second and third groups and the q frames includes first, (1+n)th and (1+2n)th frames, where n is an integer equal to or greater than 1 and equal to or smaller than 5, wherein the first, second and third groups include (3p+1)th, (3p+2)th and (3p+3)th gate lines, respectively, where p is an integer equal to or greater than 0, wherein the gate voltage of the high level is sequentially applied to the (3p+1)th gate lines during the first frame, wherein the gate voltage of the high level is sequentially applied to the (3p+2)th gate lines during the (1+n)th frame, and wherein the gate voltage of the high level is sequentially applied to the (3p+3)th gate lines during the (1+2n)th frame.

10. The device of claim 9, wherein the data voltage having one of positive and negative polarities is applied to the pixel corresponding to the (3p+1)th gate lines during a first charging period of the first frame where the gate voltage of the high level is applied to the (3p+1)th gate lines, and a pixel voltage having one of the positive and negative polarities is maintained in the pixel corresponding to the (3p+1)th gate lines during a first holding period of the first to sixtieth frames, wherein the data voltage having one of positive and negative polarities is applied to the pixel corresponding to the (3p+2)th gate lines during a second charging period of the (1+n)th frame where the gate voltage of the high level is applied to the (3p+2)th gate lines, and the pixel voltage having one of the positive and negative polarities is maintained in the pixel corresponding to the (3p+2)th gate lines during a second holding period of the first to sixtieth frames, and wherein the data voltage having one of positive and negative polarities is applied to the pixel corresponding to the (3p+3)th gate lines during a third charging period of the (1+2n)th frame where the gate voltage of the high level is applied to the (3p+3)th gate lines, and the pixel voltage having one of the positive and negative polarities is maintained in the pixel corresponding to the (3p+3)th gate lines during a third holding period of the first to sixtieth frames.

11. A method of driving a display device having a display panel, wherein the display panel includes a plurality of gate lines and a plurality of data lines crossing each other to define a plurality of pixels and is driven with a low frequency (f) being less than 60 Hz for displaying an image using the data voltage, the method comprising:

generating a gate control signal, a data control signal and an image data using an image signal;

generating the data voltage using the data control signal and the image data;

generating a gate voltage using the gate control signal;

sequentially applying the gate voltage of a high level to q groups of the plurality of gate lines during q frames of sixty frames, respectively, where q is an integer greater than 1; and applying the gate voltage of a low level to the plurality of gate lines during a plurality of other frames of the sixty frames disposed between the q frames.

12. The method of claim 11, wherein the q frames are spaced apart from each other with an equal time interval in first to sixtieth frames.

13. The method of claim 12, wherein the q groups includes first, second and third groups and the q frames includes first, twenty-first and forty-first frames, wherein the first, second and third groups include (3p+1)th, (3p+2)th and (3p+3)th gate lines, respectively, where p is an integer equal to or greater than 0, wherein the gate voltage of the high level is sequentially applied to the (3p+1)th gate lines during the first frame, wherein the gate voltage of the high level is sequentially applied to the (3p+2)th gate lines during the twenty-first frame, and wherein the gate voltage of the high level is sequentially applied to the (3p+3)th gate lines during the forty-first frame.

14. The method of claim 13, wherein the data voltage having one of positive and negative polarities is applied to the pixel corresponding to the (3p+1)th gate lines during a first charging period of the first frame where the gate voltage of the high level is applied to the (3p+1)th gate lines, and a pixel voltage having one of the positive and negative polarities is maintained in the pixel corresponding to the (3p+1)th gate lines during a first holding period of the first to sixtieth frames, wherein the data voltage having one of positive and negative polarities is applied to the pixel corresponding to the (3p+2)th gate lines during a second charging period of the twenty-first frame where the gate voltage of the high level is applied to the (3p+2)th gate lines, and the pixel voltage having one of the positive and negative polarities is maintained in the pixel corresponding to the (3p+2)th gate lines during a second holding period of the first to sixtieth frames, and wherein the data voltage having one of positive and negative polarities is applied to the pixel corresponding to the (3p+3)th gate lines during a third charging period of the forty-first frame where the gate voltage of the high level is applied to the (3p+3)th gate lines, and the pixel voltage having one of the positive and negative polarities is maintained in the pixel corresponding to the (3p+3)th gate lines during a third holding period of the first to sixtieth frames.

15. A method of driving a display device having a display panel, wherein the display panel includes a plurality of gate lines and a plurality of data lines crossing each other to define a plurality of pixels and is driven with a low frequency (f) being less than 60 Hz for displaying an image using the data voltage, the method comprising:

generating a gate control signal, a data control signal and an image data using an image signal;

generating the data voltage using the data control signal and the image data;

generating a gate voltage using the gate control signal;

sequentially applying the gate voltage of a high level to q groups of the plurality of gate lines during q frames of sixty frames, respectively, where q is an integer greater than 1, wherein the q frames are adjacent to each other within ten frames in first to sixtieth frames.

16. The method of claim 15, wherein the q groups includes first, second and third groups and the q frames includes first, (1+n)th and (1+2n)th frames, where n is an integer equal to or greater than 1 and equal to or smaller than 5, wherein the first, second and third groups include (3p+1)th, (3p+2)th and (3p+3)th gate lines, respectively, where p is an integer equal to or greater than 0, wherein the gate voltage of the high level is sequentially applied to the (3p+1)th gate lines during the first frame, wherein the gate voltage of the high level is sequentially applied to the (3p+2)th gate lines during the (1+n)th frame, and wherein the gate voltage of the high level is sequentially applied to the (3p+3)th gate lines during the (1+2n)th frame.

17. The method of claim 16, wherein the data voltage having one of positive and negative polarities is applied to the pixel corresponding to the (3p+1)th gate lines during a first charging period of the first frame where the gate voltage of the high level is applied to the (3p+1)th gate lines, and a pixel voltage having one of the positive and negative polarities is maintained in the pixel corresponding to the (3p+1)th gate lines during a first holding period of the first to sixtieth frames, wherein the data voltage having one of positive and negative polarities is applied to the pixel corresponding to the (3p+2)th gate lines during a second charging period of the (1+n)th frame where the gate voltage of the high level is applied to the (3p+2)th gate lines, and the pixel voltage having one of the positive and negative polarities is maintained in the pixel corresponding to the (3p+2)th gate lines during a second holding period of the first to sixtieth frames, and wherein the data voltage having one of positive and negative polarities is applied to the pixel corresponding to the (3p+3)th gate lines during a third charging period of the (1+2n)th frame where the gate voltage of the high level is applied to the (3p+3)th gate lines, and the pixel voltage having one of the positive and negative polarities is maintained in the pixel corresponding to the (3p+3)th gate lines during a third holding period of the first to sixtieth frames.

18. The method of claim 11, wherein the display device is a liquid crystal display (LCD) device or an organic light emitting diode (OLED) display.

* * * * *